United States Patent [19]

Sayles

[11] 3,966,663

[45] June 29, 1976

[54] FIRE-RETARDANT INSULATION FOR ROCKET MOTORS

[75] Inventor: David C. Sayles, Huntsville, Ala.

[73] Assignee: The United States of America as represented by the Secretary of the Army, Washington, D.C.

[22] Filed: Mar. 31, 1975

[21] Appl. No.: 563,427

[52] U.S. Cl. ..... 260/31.4 R; 60/39.47; 106/177; 260/32.8 A; 260/32.8 N; 260/42.29; 260/42.32; 260/45.8 A; 260/45.8 N; 526/335; 526/1

[51] Int. Cl.[2] ..... C08K 5/10; F02C 3/26

[58] Field of Search ..... 260/45.8 A, 45.8 N, 260/42.29, 31.4 R, 42.32, 94.7 A; 106/177; 60/39.47

[56] References Cited

UNITED STATES PATENTS

| | | | |
|---|---|---|---|
| 3,660,321 | 5/1972 | Praetzel et al. | 260/45.8 A |
| 3,758,426 | 9/1973 | Boivin et al. | 260/94.7 A |
| 3,792,003 | 2/1974 | Duchesne | 260/94.7 A |
| 3,835,091 | 9/1974 | Roos et al. | 260/45.8 A |
| 3,872,205 | 3/1975 | Ratte et al. | 60/39.47 |

*Primary Examiner*—Lewis T. Jacobs
*Assistant Examiner*—H. H. Fletcher
*Attorney, Agent, or Firm*—Nathan Edelberg; Robert P. Gibson; Jack W. Voigt

[57] ABSTRACT

A tetrabromo compound, e.g., tetrabromophthalic anhydride (TBPA) and tetrabromophthalimide (TBPI), their salts and derivatives, when employed as additives to the inert components when these inert components are being compounded or as crosslinking agents for these inert components, impart fire-retardancy characteristics to these inert components (liner, insulation, slivers, etc.) which undergo afterburning (combustion of the gases which are produced by the pyrolysis of the inert components with the air ingested into the rocket motor due to the free convective circulation after motor burnout).

4 Claims, No Drawings

FIRE-RETARDANT INSULATION FOR ROCKET MOTORS

DEDICATORY CLAUSE

The invention described herein may be manufactured, used, and licensed by or for the Government for governmental purposes without the payment to me of any royalties thereon.

BACKGROUND OF THE INVENTION

Numerous exploratory programs in propulsion have resulted in the development of high-performance smokeless propellants; however, the development of inert components which do not contribute to smoke in the exhaust after the propellant has been consumed has been overlooked to a large extent. The inert components can be identified as mainly the liner, insulation, and other thermal barriers. The liner is the intermediate chemical film or strata which bonds the motor wall or wall insulation to the propellant grain. In the past, the liner materials and the insulation materials have produced amounts of smoke from pyrolysis and ablation after burnout of the propellant which can sometimes exceed that produced by the propellant itself.

It is apparent that the advantages of a high-performance smokeless propellant would be offset by a major afterburning condition which produced smoke of a substantial amount.

Therefore, an object of this invention is to provide a chemical additive which is effective in functioning to prevent smoldering of the liner, and by thus preventing smoldering of the liner; the pyrolysis and ablation of the insulation material would not be a problem.

Another object of this invention is to provide a liner composition with an afterburning retardant for use with composite propellant grains.

A further object of this invention is to provide a liner composition with an afterburning retardant for use with double-base propellant grains.

SUMMARY OF THE INVENTION

Inert rocket motor components having fire-retardancy characteristics result when tetrabromophthalic anhydride (TBPA) and tetrabromophthalimide (TBPI), their salts and their derivatives are employed as additives to the inert components when these are being compounded, or when used as crosslinking agents for these inert components.

The efficacy of these polybromophthalates or polybromophthalimides as fire-retardants, and their abilities to prevent afterburning from occurring can be attributed to the lability of the hydrogen-bromine and carbon-bromine bonds. These undergo dissociation into bromine radicals. These bromine radicals inhibit the propagation of flames by acting as chain stoppers in the combustion process. The carboxyl group may also contribute to the overall combustion-quenching process because of the decarboxylation which generally occurs above 185°C.

There are several distinctly different procedures that can be used as the means of incorporating TBPA, TBPI or mixtures of TBPA and TBPI into the inert components. These are:

a. TBPA, TBPI or mixtures of TBPA and TBPI can be used as crosslinking agents when hydroxyl-terminated polybutadiene (HTPB) or polyglycol prepolymers are used as the binder for the inert components since both of these are representative propellant binders and to insure compatibility between the propellant and the liner, the same binder is generally used.

b. With the carboxylated polybutadiene prepolymers, such as, polybutadiene acrylic acid (PBAA), polybutadiene acrylic acid-acrylonitrile (PBAN), carboxyl-terminated polybutadiene (CTPB), etc. the TBPA, TBPI or mixtures are incorporated into the binder polymer by using an adequate quantity of an aziridinyl or epoxy crosslinking agent or a mixture of the latter to react with all of the available carboxyl groups.

c. Another method is to convert the TBPA into an epoxide by reacting it with an epoxyalcohol, as illustrated by:

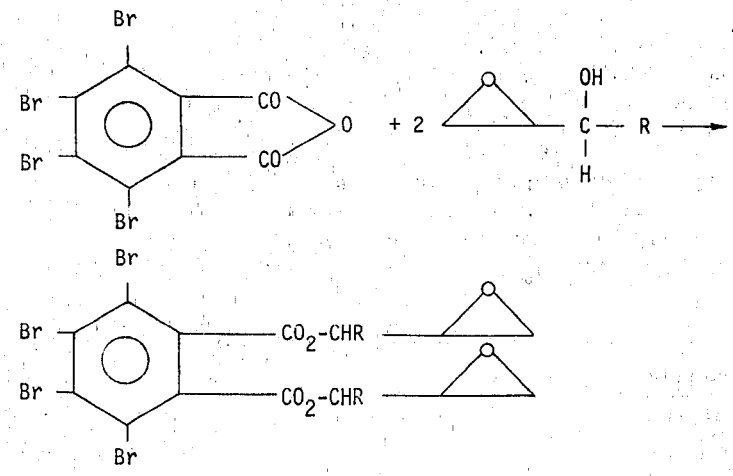

The diepoxide, thus formed, can then be used as a crosslinker for carboxylated polybutadiene prepolymers.

d. PBPA or PBPI can be incorporated in the form of a plasticizer, such as, di(2-ethylhexyl) tetrabromophthalate or N-2-hydroxyethyltetrabromophthalimide. Di(2-ethylhexyl) tetrabromophthalate can be prepared by the reaction of TBPA, and 2-ethylhexanol which is catalyzed by means of phosphoric acid, according to the procedure described by Spatz, et al in an article, entitled: "Discoloration of Tetrabromophthalic Anhy-

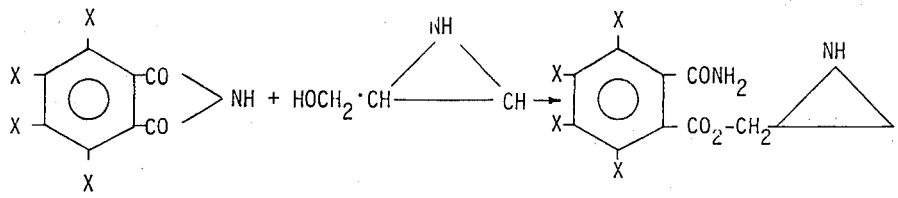

X = Br dride Polyester Resins," Chem. Engineering, Vol. 8, No. 4, Dec. 1969.

e. Diammonium tetrabromophthalate, tetrabromophthalimide, potassium tetrabromophthalimide, etc. is an additional method for incorporating tetrabromophthalate/phthalimide derivatives into insulation materials. They can be used as replacement for some of the fillers (triphenyl phosphate, Santicizer M-17, etc.).

DESCRIPTION OF THE PREFERRED EMBODIMENT

Example I illustrates the use of tetrabromophthalic anhydride (TBPA) as a curative in a HTPB prepolymer liner composition.

Example II illustrates how the salt, diammonium tetrabromophthalate, is used as a filler in a liner composition for use with a crosslinked nitrocellulose propellant to replace a filler material, Santicizer M-17, which is a trademark for the plasticizer methylphthalyl ethyl glycollate.

Example III illustrates the preparation of a reaction product of tetrabromophthalimide with 1,2-imino-1-propanol. This reaction product would, in addition to its use as a crosslinker for carboxylated polybutadiene prepolymers, have utility as an encapsulant for ammonium perchlorate. When so used the resulting encapsulated ammonium perchlorate (EAP) would have a retarded decomposition rate. When the EAP is used in a propellant composition, the propellant composition would have an extremely low burning rate. Thus, the fire-retardancy characteristic of the reaction product of tetrabromophthalimide with 1,2-imino-1-propanol, when used as an encapsulant for ammonium perchlorate, provides a convenient means for adjusting the burning rate of a propellant to a lower value.

EXAMPLE I

COMPARISON OF LINERS FOR HTPB PROPELLANTS

| INGREDIENT | COMPOSITION A | COMPOSITION B |
|---|---|---|
| HTPB prepolymer | 80–85 | 80–85 |
| TBPA | — | 10 |
| Curatives | 10 | — |
| Additives | 1–3 | 1–3 |
| Fillers | 4–10 | 4–10 |

EXAMPLE II

COMPARISON OF LINERS FOR CROSSLINKED NITROCELLULOSE PROPELLANTS

| INGREDIENT | COMPOSITION A | COMPOSITION B |
|---|---|---|
| Cellulose Acetate | 49 | 49 |
| Triphenyl phosphate | 31 | 31 |
| Santicizer M-17 | 19 | — |
| Diammonium Tetrabromophthalate | — | 19 |
| Toluene Diisocyanate | 2.4 | 2.4 |
| Acetone | 615 | 615 |
| Methyl Cellosolve Acetate (2-methoxy ethanol acetate) | 484 | 484 |

An encapsulant for AP, derived from fire-retardant material, would permit the ammonium perchlorate particle to move further from the propellant surface before it would start to undergo decomposition, and, thus, the amount of heat which would be transferred back to the propellant grain would be less than what occurs in present systems.

The above reaction product of tetrabromophthalimide with 1,2-imino-1-propanol which contains an aziridinyl moiety and a moiety derived from tetrabromophthalimide is a desirable encapsulant for AP since it adheres well to AP. A special synthetic approach is necessary, however, to preclude attack by the acidic hydrogens of the polybromocompound of the aziridinyl group.

For greater compatibility, the liner materials used for rocket motors are generally fabricated of the same type binder used in the propellant grain. For example, a hydroxy-terminated propellant grain would employ a hydroxy-terminated binder material in the liner. The curing agent could be a diisocyanate curing agent. The filler materials and additives can be carbon black, metallic oxides, such as, titanium dioxide, and the like. The carboxy-terminated propellant grain would employ a carboxy-terminated polybutadiene binder material in the liner. The curing agent could be an epoxide curing agent, such as, 4,5-epoxycyclohexylmethyl-4,5-epoxycyclohexyl carboxylate. The liner material that is used with a crosslinked nitrocellulose propellant type grain uses organic solvents and compounds of the type set forth in Example II.

PROCEDURE FOR EVALUATING AFTERBURNING RETARDANTS

The disclosed compositions of this invention are evaluated as afterburning retardants by completing a series of test firings. The level of afterburning which results from a series of small motor firings clearly demonstrates the beneficial effects when these afterburning retardants are used as described.

The test firings include loading a composite propellant such as TPH-8041 into a small test motor designated as 6C-11.5. The insulated motor case is lined with Composition B of Example I for the composite HTPB propellant load. When a crosslinked nitrocellulose propellant is to be loaded into the motor, the insulated motor case is lined with Composition B of Example II. The actual testing comprises static firing two or more motors of each different liner-propellant formulation at 0° and +165°F.

The evaluation includes comparison movie coverage by photographing through the exhaust plume at two different angles (45° and 90°) of a multicolored background screen having black, white, green, and blue panels. Visual sightings during the firing confirm the photographic evidence. The difference in the smoke signature from the different liners is remarkably clear, and the beneficial effect produced by the afterburning retardant is very evident. There is a very abrupt cutoff in propellant-produced smoke at the end of propellant burning as soon as the special liner surface employing either compositions B of Example I or Example II is exposed.

I claim:

1. The combination comprised of a tetrabromo compound selected from tetrabromophthalic anhydride, tetrabromophthalimide, di(2-ethylhexyl) tetrabromophthalate, N-2-hydroxyethyl-tetrabromophthalimide, diammonium tetrabromophthalate, potassium tetrabromophthalimide, an epoxide of tetrabromophthalic anhydride, and an epoxide of tetrabromophthalimide, with a binder and a curing agent for said binder, said combination being the ingredients for use as an inert rocket motor component of a solid-propelled rocket motor, and being further identified as said inert rocket motor component which serves as either a liner composition for a composite propellant rocket motor or a crosslinked nitrocellulose propellant rocket motor, said liner composition serves to bond the motor wall or wall insulation to the solid propellant grain of said solid-propelled rocket motor, or as an insulation or thermal barrier, said selected compound when in said combination being effective in preventing afterburning of said inert rocket motor component, said liner composition for said composite propellant rocket motor comprised of about 80–85 parts by weight of hydroxy-terminated polybutadiene prepolymer binder with a diisocyanate curing agent, of about 1–4 parts by weight of carbon black additive, of about 4–10 parts by weight of inert fillers, and a curative of about 10 parts by weight of said selected tetrabromo compound; and said liner composition for said crosslinked nitrocellulose propellant rocket motor comprised in parts by weight of a binder of about 49 parts cellulose acetate, of about 31 parts triphenyl phosphate, of about 615 parts acetone, of about 484 parts of an activator 2-methoxy ethanol acetate, of about 2–4 parts of a diisocyanate curing agent, and of about 19 parts of said selected tetrabromo compound.

2. The combination of claim 1 wherein said selected tetrabromo compound is used in the inert rocket motor component which is a liner composition for a composite propellant rocket motor, said selected tetrabromo compound being tetrabromophthalic anhydride.

3. The combination of claim 1 wherein said selected tetrabromo compound is used in the inert rocket motor component which is a liner composition for a crosslinked nitrocellulose propellant rocket motor, said selected tetrabromo compound being diammonium tetrabromophthalate.

4. The combination of claim 3 wherein said diisocyanate curing agent is toluene diisocyanate.

* * * * *